US005803257A

United States Patent [19]

Bartholomew

[11] Patent Number: 5,803,257

[45] Date of Patent: Sep. 8, 1998

[54] PANEL CRATING STRUCTURE

[75] Inventor: David M. Bartholomew, Greensburg, Pa.

[73] Assignee: Menasha Corporation, Neenah, Wis.

[21] Appl. No.: 745,166

[22] Filed: Nov. 7, 1996

[51] Int. Cl.[6] ..... B65D 85/48

[52] U.S. Cl. ..... 206/454; 206/451; 206/453

[58] Field of Search ..... 206/454, 451, 206/449, 453, 597, 386, 593, 506, 509, 511

[56] References Cited

U.S. PATENT DOCUMENTS

| | | | |
|---|---|---|---|
| 1,714,692 | 5/1929 | Pagel et al. . | |
| 1,910,783 | 5/1933 | Way . | |
| 2,015,419 | 9/1935 | Ceely . | |
| 2,214,173 | 9/1940 | Nebe | 206/597 |
| 2,281,657 | 5/1942 | Aquino . | |
| 2,792,936 | 5/1957 | Johnson . | |
| 2,811,249 | 10/1957 | Swain et al. . | |
| 2,885,139 | 5/1959 | Werner et al. | 206/453 |
| 2,905,114 | 9/1959 | Olson . | |
| 3,233,753 | 2/1966 | Rich . | |
| 3,273,706 | 9/1966 | Bundy . | |
| 3,403,777 | 10/1968 | Bucko . | |
| 3,547,457 | 12/1970 | Langer . | |
| 3,618,755 | 11/1971 | Kean, Sr. | 206/453 |
| 3,645,389 | 2/1972 | Castiaux . | |
| 3,713,579 | 1/1973 | Chaffers | 206/509 |
| 3,720,035 | 3/1973 | Rutter | 206/453 |
| 3,805,473 | 4/1974 | Lidgard | 206/451 |
| 3,946,868 | 3/1976 | Rutter | 206/453 |
| 4,019,634 | 4/1977 | Bonnot . | |
| 4,241,832 | 12/1980 | Bliss . | |
| 4,467,922 | 8/1984 | Rowley . | |
| 4,512,473 | 4/1985 | Thomaswick et al. . | |
| 4,645,122 | 2/1987 | Nederveld | 206/509 |
| 4,960,209 | 10/1990 | Tudor | 206/451 |
| 5,154,297 | 10/1992 | Farley | 206/453 |
| 5,174,448 | 12/1992 | Flaig | 206/451 |

FOREIGN PATENT DOCUMENTS

| | | | |
|---|---|---|---|
| 103535 | 3/1984 | European Pat. Off. | 206/509 |
| 2268712 | 11/1975 | France | 206/597 |

*Primary Examiner*—Paul T. Sewell
*Assistant Examiner*—Anthony Stashick
*Attorney, Agent, or Firm*—Quarles & Brady

[57] ABSTRACT

A package for shipping and storing a bundle of glass panels includes a plurality of molded plastic corner caps, wherein each one has an L-shaped cross section for embracing one corner of the bundle formed by the intersection of two edges of each glass panel. Each pair of corner caps is coupled by a separate side sheet that is securely received in a cavity of each corner cap to prevent racking of the panel bundle. A pair of plates are slidably mounted on each corner cap hold the bundle of panels between the plates. A number of strapping bands extend around the corner caps and the bundle of panels running parallel to elongated dimension of all the edges of the panels. An optional support tray to be engaged by material handling equipment may be held beneath the panel bundle by the strapping bands.

16 Claims, 2 Drawing Sheets

PANEL CRATING STRUCTURE

BACKGROUND OF THE INVENTION

The present invention relates to containers for storing and shipping panels, such as panes of glass.

Flat sheets of glass are commonly shipped in a bundle comprising a plurality of sheets of identical rectangular dimensions with a powdered interleaving between abutting sheets. The bundle often is secured in a steel rack which can be handled by a forklift or similar material handling equipment. The steel racks can be stacked upon one another in a warehouse with the lower racks supporting the weight of the racks above.

Although the steel racks protect the glass during shipment and storage, there are two drawbacks to their use. The racks are not adjustable and are fabricated in a size that is able to hold the largest panels of glass produced by the manufacturer. Thus when smaller panels are shipped and stored, the container takes up a significantly larger volume than that required by the bundle of glass. In addition the steel racks weight between 300 and 600 pounds which adds significantly to the shipping weight and thus the freight costs. Further the weight also determines the cost of returning the racks to the manufacturer for reuse.

SUMMARY OF THE INVENTION

A general object of the present invention is to provide a protective packaging structure in which to ship and store a bundle of panels, such as glass panes.

Another object is to provide a relatively inexpensive and light weight packaging structure which still provides structural integrity to the bundle of panels.

A further object of the present invention is to provide a packaging structure that can be used with different size bundles of different sizes conforming to the size of the bundle being shipped and stored, so that the packaging does not add significantly to the size of the materials contained therein.

Yet another object is to provide a packaging structure that allows several panel bundles to be stacked vertically.

A still further object of the present invention is to provide a packaging container which protects the corners of each panel in the bundle being shipped.

These and other objectives are satisfied by a packaging structure that includes a corner cap located at corners of the bundle of panels where two edges of the panels intersect. Each corner cap extends across two edges of all the panels and has a base and a retainer member connected together at an angle for embracing the corner of the bundle. Each pair of the corner caps is coupled by a separate rigid side sheet securely received within the retainer members of the pair corner caps to prevent racking of the bundle of panels. A plurality of strapping bands extend around the corner caps and the bundle of panels in a direction that is parallel to the longitudinal axis of all the edges of the panels. The strapping bands hold the caps and the sheets together in an integral structure.

In the preferred embodiment of the packaging structure, a pair of plates are slidably mounted on each corner cap hold the bundle of panels between the plates. An optional support tray may be held beneath the panel bundle by the strapping bands to provide a surface for engagement by material handling equipment.

DETAILED DESCRIPTION OF THE INVENTION

Figure 1:
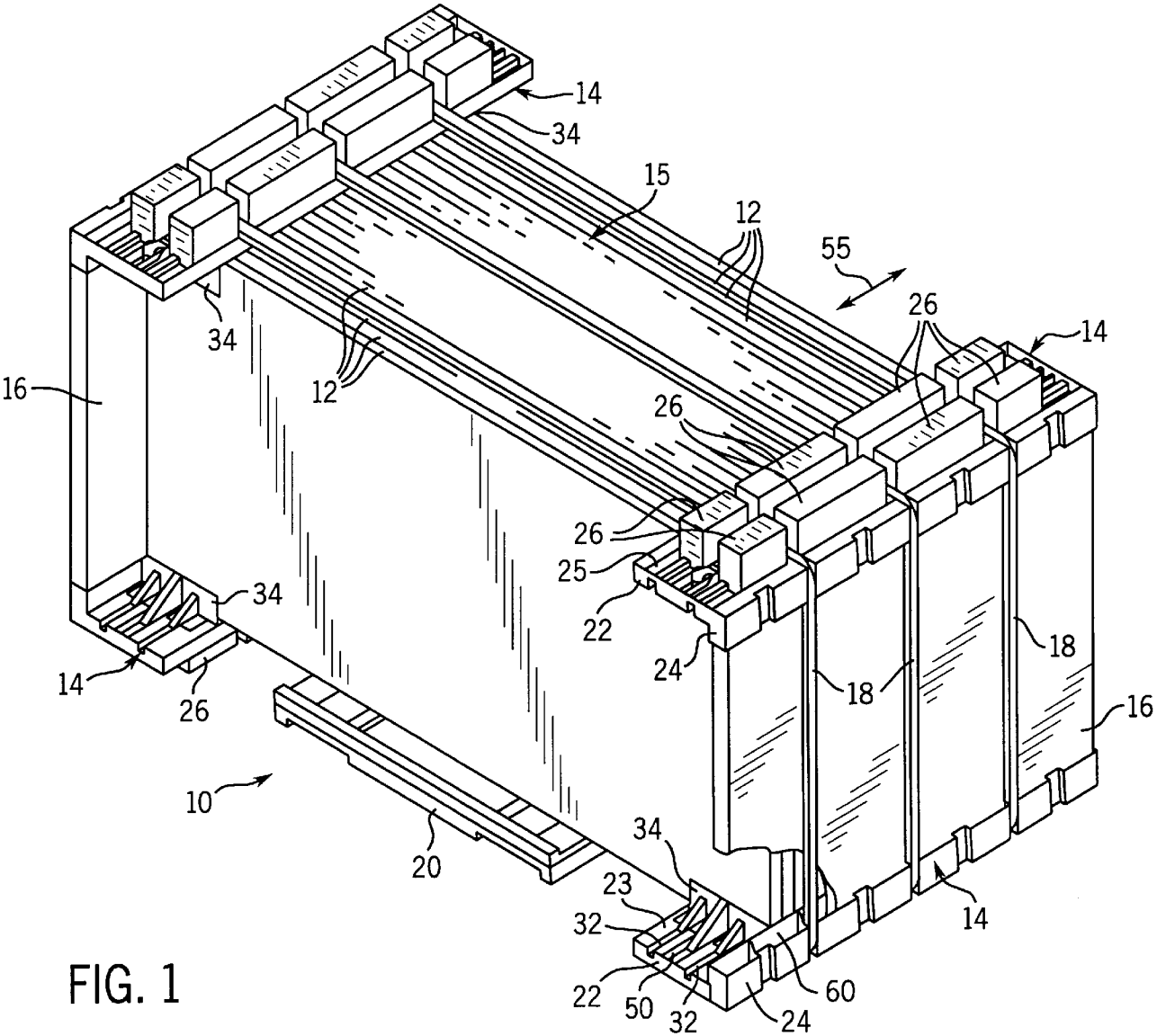
FIG. 1 is an isometric view of a bundle of panels contained within a packaging structure according to the present invention.

With initial reference to FIG. 1, each one of a plurality of rectangular glass panels 12 of like size and shape has two major surfaces with four edges extending between those surfaces. The glass panels 12 are placed on edge and arranged in a bundle 15 with their major surfaces abutting one another. A packaging structure, generally designated 10, is utilized to transport the bundle of glass panels 12 with their shorter edges being oriented vertically.

The packaging structure 10 comprises four corner caps 14 extend across the edges of all panels at different corners of the bundle 15 where two edges of the panels intersect. The corner caps 14 are preferably fabricated of molded plastic and protect the corners of the glass panels from damage. The corner caps 14 extend beyond the exposed major surfaces of the outer glass panels 12 in the bundle 15 to offer some degree of protection against objects striking those surfaces. This extension beyond the outer glass panels also spaces the bundles 15 from one another when placed side-by-side during shipment and storage.

A rigid side sheet 16, of 9/16 inch thick corrugated cardboard, oriented strand board or plastic for example, extends between two corner caps 14 at each small end of the bundle 15. Alternatively, the side sheet would extend across the longer edges of the glass panels 12, but that would require larger sheets. The side sheet 16 fits within a cavity 60 in each corner cap 14 and prevents racking of the bundle 15. The corner caps 14 and side sheets 16 are held in place on the bundle by three metal or plastic strapping bands 18 which extend vertically between the corner caps 14 at each end of the bundle and then extend horizontally across the top and bottom of the bundle 15. In other words the strapping band run around the bundle parallel to the length of the edges of the glass panels 12. The strapping bands 18 also hold a lifting tray 20 on the under side of the bundle 15.

Figure 2:
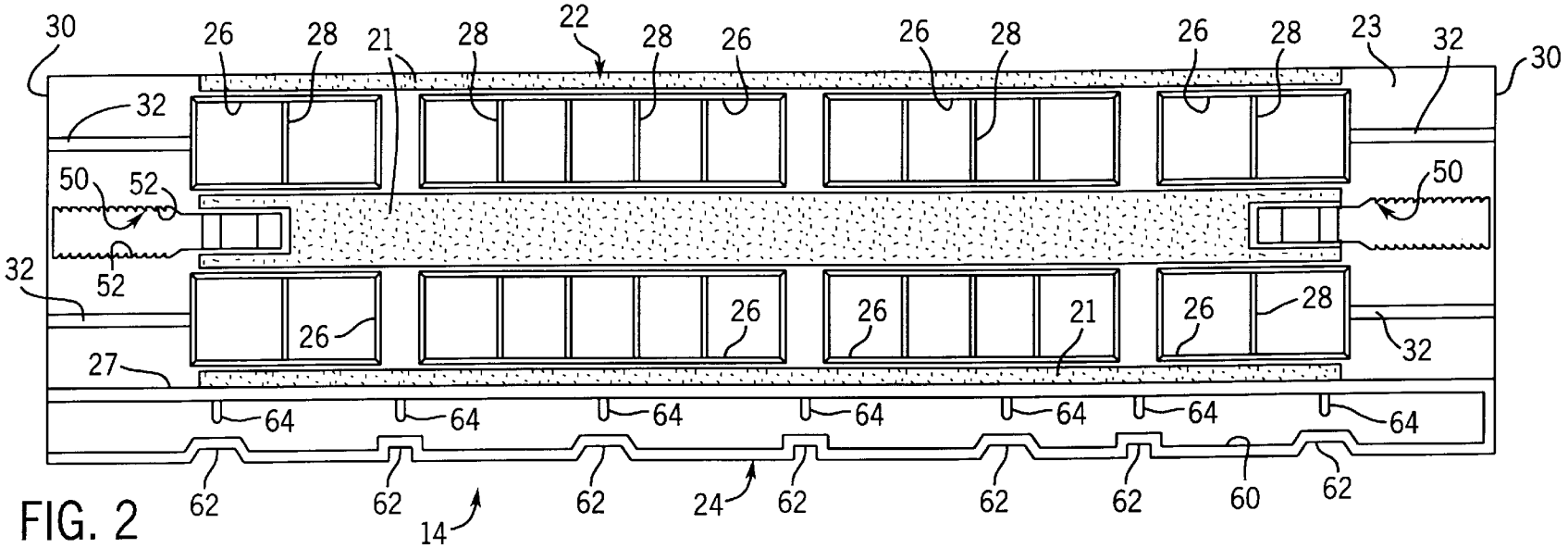
FIG. 2 is an plane view of a corner cap of the packaging structure.

With reference to FIGS. 1 and 2, each corner cap 14 has a base 22 with an inside major surface 23 from which a retainer box 24 projects orthogonally along one elongated side of the base. The retainer box 24 forms the cavity 60 within which the side sheet 16 is received. This orientation of the base 22 and retainer box 24 give the corner cap 14 an L-shaped cross-section with an inside corner that embraces the corner of the glass panel bundle 15. Strips 21 of rubber foam or other resilient material are applied to the inside major surface 23 of the base 22 to cushion the edges of the glass panels 12. A rubber foam layer 27 also cushions the corresponding surface of retainer box 24.

Eight hollow, rectilinear feet 26 project away from the outside major surface 25 of the base 22 which is opposite to the inside surface 23 that is in contact with the bundle 15 of glass panels 12. Thus the feet 26 extend upward and downward from the bundle. As shown in FIG. 2, the hollow interior of each foot 26 is subdivided by at least one interior wall 28 for increased structural integrity. The four outermost feet 26 are smaller than the four interior feet and have only a single interior wall 28, while the four larger inner feet have three interior walls 28. As will be described, the feet 26 hold the bundle 15 above the floor allowing a fork of an industrial truck to slide under the packaging structure 10. The feet 26 also enable several bundles 15 to be stacked above one another with a space provided under each one for the industrial truck fork.

On the inside surface 23 at each narrow end 30 of the base 22 are two guide channels 32 that extend lengthwise along the base to receive guide tabs of a pair of slide plates 34. One of the molded plastic slide plate 34 is shown in detail in FIG. 3 and comprises a rectangular wall 36 which projects orthogonally to the surface 23 of the base when assembled as seen in FIG. 1. A pair of feet 38 project at opposite ends from the bottom edge of the wall 36 to support the wall slightly above the base surface 23 thereby reducing the friction when the slide plate 34 moves along that surface, as will be described. Two triangular buttresses 40 project from the outer major surface 35 of the wall 36 and terminate at the remote apexes which have guide tabs 42 that fit within the guide channels 32 of the base 22. A pair of locking arms 44 also project from the central region of the outer major surface 35 of wall 36. The remote ends of the locking arms 44 are flared outward and terminate in an end surface 46. Each of these ends also has a retaining ear 48 which extends outwardly from the bottom surface of the locking arms 44.

When the slide plate 34 is placed onto the base 22 the guide tabs 42 enter the channels 32 and the ends of the locking arms 44 fit within a central groove 50 in the inside surface 23 at the respective end 30 of base. The locking arms 44 extend slightly downward and into the central groove 50 and the retaining ears 48 fit under the edges 52 of the groove to hold the slide plate 34 on the base 14. Each of the opposing edges 52 has a saw tooth pattern provides a ratchet mechanism in cooperation with the end surface 46 of locking arms 44.

Figure 3:
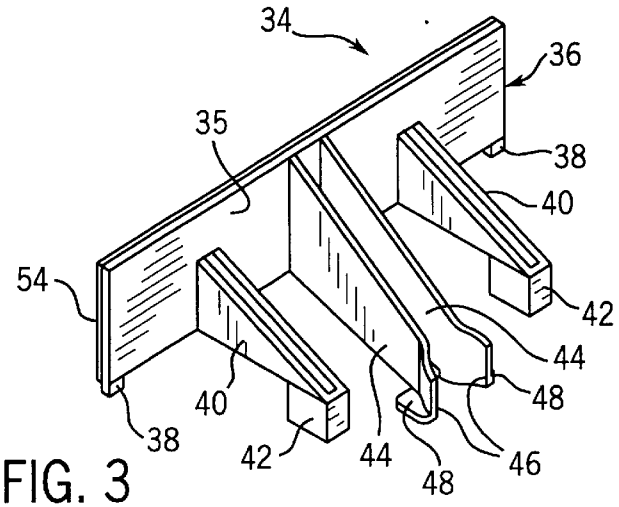
FIG. 3 is an isometric view of a slide plate which is utilized with the corner caps.

Thus as can be seen with reference to FIGS. 1–3, when a corner cap 14 is placed on the corner of the glass panel bundle 15, the bundle is centrally positioned along the length of the corner cap. Then the slide plates 34 at each end 30 of the corner cap 14 are slid inward along channels 32 until their interior major surfaces 54 contact the outermost panels of the glass bundle 15. While this sliding action is occurring, the locking arms 44 are being ratcheted along the saw tooth pattern on the opposing edges 52 of the central groove 50. The ratchet mechanism locks the slide plates 34 into contact with the glass panel bundle 15 and prevents them from loosening. However, a user is able to readjust the position of a slide plate 34 by pressing the locking arms 44 together releasing the engagement of their end surfaces 46 with the saw tooth opposing edges 52 of the central groove 50. This allows the slide plate 34 to be slid along the channels 32 away from the glass panel bundle 15. The pair of slide plates 34 on each corner cap 14 allows the packaging structure 10 to accommodate different numbers of glass panels 12 and panels of different thickness.

Referring again to FIGS. 1 and 2, the retainer box 24 of each corner cap 14 has an interior cavity 60 within which an edge of side sheet 16 is received. Alternatively, the small end walls of retainer box 24 could be eliminated so that the cavity 60 is formed by a U-shaped channel extending the length of the corner cap. The outer wall of the cavity has a waffle-like pattern with inwardly extending regions 62 that contact the surface of the side sheet 16. A separate rib 64 is associated with each waffle indentation and projects into the cavity from the opposing wall of the retainer box 24. When the strapping bands 18 are tightened around the assembled package, the side sheet 16 is forced into the cavity 60 of the retainer box 24 and the ribs 64 bite into the edge of the side sheet 16 securing the corner cap 14 and the side sheet together. The side sheet 16 secured in this manner provides structural connection between the two corner caps and prevents the bundle 15 of glass panels 12 from racking, i.e. tilting along directions indicated by arrows 55.

Figure 4:
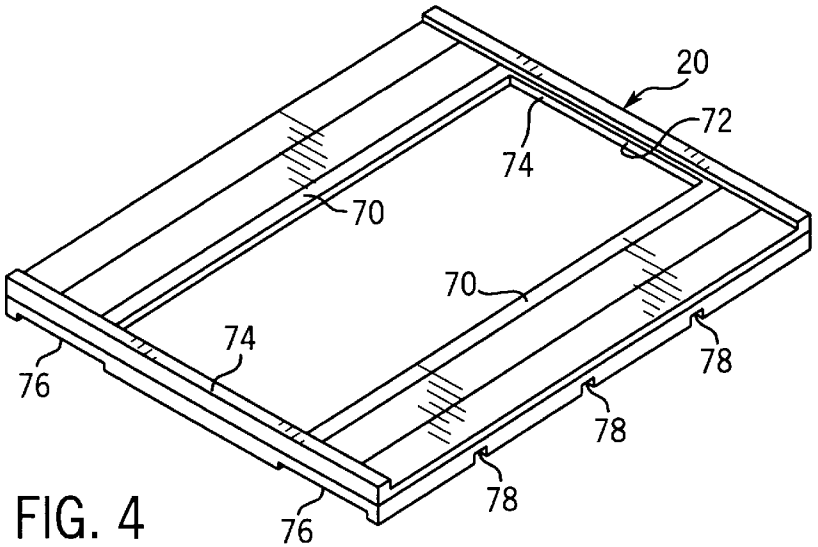
FIG. 4 is an isometric view of a bottom support tray of the packaging structure.

FIG. 4 illustrates the tray 20 which is secured under a bundle 15 of large glass panels 12 to provide a support surface for forks of an industrial truck fork or other material handling device. The wooden or molded plastic tray 20 preferably has the form of a frame with a central rectangular opening 72 in order to reduce the amount of material utilized in the tray. The tray 20 thus is formed by a pair of horizontal planks 70 spaced apart and extending across the underside of all the glass panels 12. The ends of the two horizontal planks 70 are connected by transverse rails 74 to complete the tray frame. The underside surface of each of the planks 70 has a longitudinal notch 76 adapted for receiving tines of the industrial truck fork. The underside surface of each plank 70, also has three narrow transverse grooves 78 through which the strapping bands 18 pass to secure the tray 20 to the underside of the glass panel bundle 15. Although the tray 20 is not essential to the structural integrity of the packaging structure 10, it serves to prevent the industrial truck fork from damaging the glass panels 20. Alternatively, the tray 20 could be eliminated from the packaging structure 10 if the fork or other lifting devices are sufficiently padded to prevent damage to the glass.

Several packaging structures 10 can be stacked one on top of another in a warehouse because the glass panels 12 are stacked on edge in the bundle 15. The end caps 14 distribute the weight of the higher bundles across the edges of all the panels in the bundle to which the caps are attached. This on-edge orientation takes advantage of the compressive strength of the glass panels which enables the lower bundles to support the load of the bundles above without breaking.

The present packaging structure 10 provides a low cost packaging mechanism for safely shipping and storing panels such as glass panes, doors and sheet goods. In addition this packaging structure offers significant weight reduction over steel racks previously employed to ship and store glass panels.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. Accordingly, the scope of the invention should be determined from the following claims and not limited by the above disclosure.

I claim:

1. A packaging structure for a bundle of panels with each panel having two major surfaces and a plurality of edges connecting the two major surfaces, said packaging structure comprising:

a plurality of corner caps with each one located at a corner of the bundle where two edges of each panel intersect and extend across the edges of every panel, and each corner cap having a base with a retainer extending therefrom at an angle for embracing one corner of the bundle, wherein the retainer of each corner cap has a plurality of ribs;

a plurality of sheets with each sheet received within the retainer of two of the plurality of corner caps to prevent racking of the bundle of panels and wherein the plurality of ribs bite into the plurality of sheets; and a plurality of strapping bands extending around the plurality of corner caps and the bundle of panels.

2. The packaging structure as recited in claim 1 wherein each corner cap is formed by molded plastic.

3. The packaging structure as recited in claim 1 wherein the edges of the panels have a length axis and the plurality of strapping bands extend parallel to the length axis of all edges of the panels.

4. The packaging structure as recited in claim 1 wherein the base has a plurality of feet projecting therefrom away from the bundle of panels.

5. The packaging structure as recited in claim 1 wherein the retainer of each corner cap forms a cavity for receiving an edge of one of the plurality of sheets.

6. The packaging structure as recited in claim 5 wherein the plurality of sheets are formed of material selected from the group consisting of wood, oriented strain board, plastic and corrugated cardboard.

7. A packaging structure for a bundle of panels with each panel having two major surfaces and a plurality of edges connecting the two major surfaces, said packaging structure comprising:

a plurality of corner caps with each one located at a corner of the bundle where two edges of each panel intersect and extend across the edges of every panel, and each corner cap having a base with a retainer extending therefrom at an angle for embracing one corner of the bundle, each of the plurality of the corner caps has a slide plate movably mounted to the base for engaging the bundle of panels;

a plurality of sheets with each sheet received within the retainer of two of the plurality of corner caps to prevent racking of the bundle of panels ; and a plurality of strapping bands extending around the plurality of corner caps and the bundle of panels.

8. The packaging structure as recited in claim 7 wherein the slide plate comprises a wall with one surface for engaging the bundle of panels and an opposing surface and, a pair of buttresses extending from the opposing surface and resting against the base.

9. The packaging structure as recited in claim 7 wherein the base has a guide channel; and the slide plate comprises wall with a buttress extending from the wall and into the guide channel.

10. The packaging structure as recited in claim 9 wherein the base has a surface with teeth; and the slide plate further comprises an arm which releasably engages the teeth to provide a ratchet mechanism for holding the slide plate against the bundle of panels.

11. The packaging structure as recited in claim 1 further comprising a support tray held beneath the bundle of panels by the plurality of strapping bands.

12. The packaging structure as recited in claim 11 wherein the support tray has a pair of grooves for receiving tines of a lifting fork of an industrial truck.

13. A packaging structure for a bundle of panels with each panel having two major surfaces and a plurality of edges connecting the two major surfaces, said packaging structure comprising:

a plurality of molded plastic corner caps with each one located along a corner of the bundle where two edges of each panel intersect, and each corner cap having a base and a retainer connected together to form an L-shaped cross section for embracing one corner of the bundle, with the retainer forming a cavity, wherein each of the plurality of corner caps further comprises first and second slide plates movably located at opposite ends of the base for holding the bundle of panels between the first and second slide plates;

a plurality of side sheets with each being received within the cavity of retainers of two of the plurality of corner caps to prevent racking of the bundle of panels; and a plurality of strapping bands extending around the plurality of corner caps and the bundle of panels parallel to elongated dimension of all the edges of the panels.

14. The packaging structure as recited in claim 13 wherein the base has a plurality of feet projecting therefrom away from the bundle of panels.

15. The packaging structure as recited in claim 13 wherein the base has two guide channels and a groove with teeth; and wherein each first and second slide plate has a wall, with two buttresses extending from the wall into the guide channels and an arm extending from the wall and releasably engaging one of the teeth to secure the slide plate against the bundle of panels.

16. The packaging structure as recited in claim 13 further comprising a support tray held beneath the bundle of panels by the plurality of strapping bands.

* * * * *